United States Patent [19]

Budzich et al.

[11] 4,254,164

[45] Mar. 3, 1981

[54] METHOD OF DEPOSITING COPPER ON COPPER

[75] Inventors: Mieczyslaw Budzich; Forest G. Fitz, Jr., both of Lexington, S.C.

[73] Assignee: Nassau Recycle Corporation, Staten Island, N.Y.

[21] Appl. No.: 55,867

[22] Filed: Jul. 6, 1979

[51] Int. Cl.[3] ..... B32B 35/00; B05D 3/02; B05D 3/12; B05D 1/08

[52] U.S. Cl. ..... 427/142; 427/319; 427/328; 427/367; 427/423; 428/675

[58] Field of Search ..... 29/527.2, DIG. 39; 164/46; 219/76.16, 121 P; 427/37, 319, 271, 287, 405, 423, 355, 328, 367, 369, 142; 428/675

[56] References Cited

U.S. PATENT DOCUMENTS

| | | | |
|---|---|---|---|
| 3,428,442 | 2/1969 | Yurasko | 428/675 X |
| 3,742,585 | 7/1973 | Wentzell | 29/423 |
| 3,947,607 | 3/1976 | Gazzard et al. | 427/37 |

FOREIGN PATENT DOCUMENTS

| | | | |
|---|---|---|---|
| 492904 | 5/1953 | Canada | 427/423 |

*Primary Examiner*—Michael R. Lusignan
*Attorney, Agent, or Firm*—Robert B. Kennedy

[57] ABSTRACT

A method is disclosed for depositing a thick layer of copper upon a copper base wherein the base is heated and flame sprayed with molten copper until globules are observed. The globules are mechanically removed from the base and the flame spraying and globules removing steps repeated.

4 Claims, 1 Drawing Figure

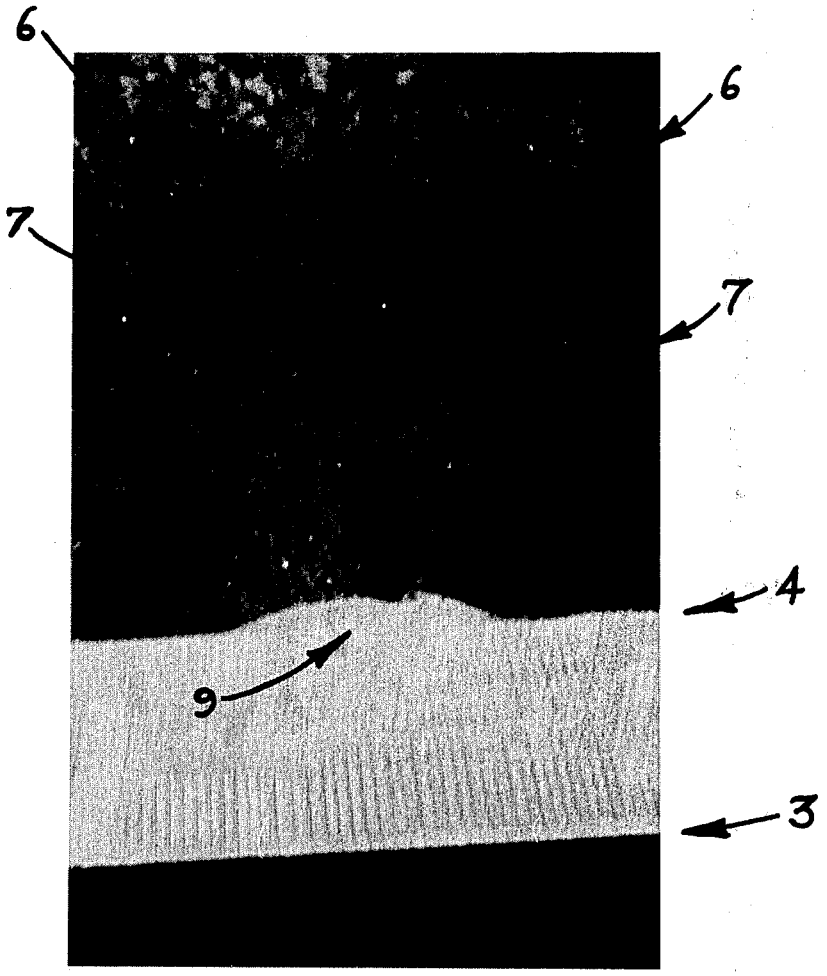
6
6
7
7
4
9
3

METHOD OF DEPOSITING COPPER ON COPPER

TECHNICAL FIELD

This invention relates to methods of depositing thick layers of copper on copper bases.

BACKGROUND OF THE INVENTION

There often exists a need to deposit a substantially thick layer of copper upon copper as where a previously copper cast article is to be rebuilt or repaired. For example, in the casting of large industrial anodes molten copper is fed into a precasted, relatively cool mold which itself is made of copper. As copper anodes are made from the molds they become repetitively subjected to severe stresses caused by thermal cycling. In addition, some diffusion of metal occurs between the copper molds and the copper anodes being casted. As a result, some portions of the molds become rapidly degraded or depleted. In fact, it is not uncommon for the copper molds to have to be discarded after some ten days usage due to structural degradation or reshaping of the molds.

In some cases it is preferable to repair rather than to discard damaged molds due to considerations of availability, purchase lead time, and remoteness of location. Unfortunately, it has not heretofore been known how to effect repair since it has not been known how to deposit a relatively thick layer of copper upon a copper base so as to produce a structurally sound, unitary body.

There have heretofore existed methods of applying a thin layer of copper upon a copper substrate. For example, U.S. Pat. No. 3,742,585 teaches one such method wherein copper metal powder is sprayed in an inert atmosphere with a plasma gun onto a substrate of copper foil while the foil is in intimate contact with a cooling element. Methods have also been devised for depositing thin layers of copper on non-copper bases. U.S. Pat. No. 3,947,607, for example, teaches a method of forming copper on an aluminum alloy piston by spraying copper from an electric arc spray gun that produces molten particles of a size, velocity and heat content sufficient to produce an effective metallurgical reaction with the piston alloy so that the copper material becomes bonded thereto.

Although a layer of copper may be deposited on a non-copper metallic base with a spray gun, such method is not effective in depositing a thick layer of copper such as one greater than film sizes on a copper base. Where molten copper is sprayed onto a surface area of a copper base larger than the spray impact area itself to an appreciable thickness, it is soon discovered that the deposited material lacks structural integrity and can easily become broken off from the base material. Upon examination it can be determined that this is due to the presence of appreciable quantities of copper oxides within the layer of deposition. The formation of these oxides could, of course, be avoided by carrying out the deposition process in an inert atmosphere as done in the film deposition process described in the first mentioned patent. Environmentally controlled chambers, however, are often unavailable in the field just as casting facilities are not available as previously mentioned. The present invention thus is directed at alleviating these problems by providing a method of effectively depositing copper on copper bases which may be conducted without casting facilities or environmentally controlled chambers.

SUMMARY OF THE INVENTION

In a preferred form of the invention a method is provided for depositing a thick layer of copper upon a copper base. The method comprises the steps of heating the base and flame spraying molten copper onto an area of the heated base until globules are observed forming in the area indicative of a build-up of thermal barrier oxide. The globules are then mechanically removed from the base, and the flame spraying and globules removing steps repeated.

BRIEF DESCRIPTION OF THE FIGURE

The FIGURE is a photolithograph showing a copper bar upon a portion of which a thick, irregularly contoured layer of copper has been deposited and allowed to oxidize.

DETAILED DESCRIPTION

To thicken an article or body by depositing a thick layer of copper on a copper base, the surface area to be built up is first cleaned as by grinding or sanding and then sand blasting. The base is next preheated to a temperature preferably between some 1200° F. and 1600° F. A flame spray gun, such as that manufactured by Metco Incorporated of Westbury, Long Island, N.Y., is then used to flame spray molten copper onto the cleansed area. The gun is held some six inches or so away from the surface as the gun is moved or reoriented over the area to be rebuilt. A spray of molten copper is moved over the area. As the flame spray momentarily impinges upon any one portion of the area the surrounding portions not at that moment being impacted are observed.

After a brief period of time, such as 2–3 minutes, globules will begin to appear in the area being treated. If the center portion of the area is being rebuilt to a greater degree than the peripheral portion, as is commonly the case, the globules will usually first appear in the peripheral portion. At this time flame spraying is suspended whereupon the globules will be observed to darken and thereby become more readily identifiable from the surrounding area not being treated and which is free of globules. The globules are then mechanically removed from the area as with the use of a Black and Decker Sander Model No. 40770, or with some other type of hand grinder such as one of the line sold by the Milwaukee Tool Company. After the globules have been removed the area is again sandblasted and flame sprayed as before until such time as the globules reappear whereupon the flame spraying operation is again suspended and the globules removed. This procedure is repeated until the area is built up to the level and contour desired.

Although the metallurgical processes involved in the just described process are as yet not fully understood it is believed that the following occurs. By preheating the copper base to a temperature of between 1200° F. and 1600° F. the bar surface to be built up becomes sufficiently heated to enable the molten copper deposited by the flame spray to be integrally cast with the base material. If a temperature of the bar is elevated less than some 1200° F. the bar tends to cool as the procedure progresses to such a degree as to cause oxides to form too quickly to permit a proper build-up of a substantially unoxidized layer. In addition, if the base becomes too cool it will cause the sprayed molten copper to cool too rapidly. Conversely, should the temperature of the bar be raised to a point substantially in excess of some 1600° F. the heat radiated from the bar makes it extremely difficult for a worker to operate a hand held spray gun and to observe formation and remove the globules.

As the flame spray impinges on the area to be built up the temperature at the site of momentary impact is sufficient to prevent oxidation from occurring. However, since it is necessary to move the spray over the area being treated, the area not directly under impact of the spray tends to cool and to oxidize. A slight degree of oxidation evidently does not impair the structure being formed to any significant degree. In time, however, a substantial degree of oxidation will occur over the area in general as evidenced by the appearance of the globules. Although these globules are of substantially the same color as that of the non-globulated material they will, in time, darken. The photolithograph of the drawing depicts this.

In the photolithograph a copper bar that has been treated with the present method is shown cut across the center of the built-up area with the bottom edge of the cut shown at 3 and the top edge shown at 4. The top surface of the bar is seen to have a relatively light area 6 about a relatively dark area 7. The dark area is seen to be of a granular or globulated texure while the lighter area is smooth. Thus, the darkened, globulated area is the surface of the built-up area that is oxidized as previously described. The thickness of the built-up area at this particular point is seen to be substantial as indicated by reference 9. The bar pictured has been allowed to cool for some time to allow for a substantial darkening of the globules to occur for clarity of illustration here.

As previously stated, once the globulated area has appeared flame spraying is suspended. Were further flame spraying to occur, the molten copper of the spray would be deposited upon the globulated area comprised of copper oxides. These copper oxides form a brittle, thermal barrier relative to the metallic copper. As a result a layer of molten copper sprayed upon the oxide layer would not be integrally cast with the base. Instead, it would adhere relatively poorly to a layer of oxide. Again, this is believed to be due to the oxide converting the base here from an excellent heat sink into a thermal barrier. By intermittently removing this barrier the build-up may be continued to the height desired.

It should be understood that the just described embodiment merely illustrates principles of the invention in one preferred form. Many modifications, additions and deletions may, of course, be made thereto without departure from the spirit and scope of the invention as set forth in the following claims.

What is claimed is:

1. The method of depositing copper on a copper base comprising the two steps of:

(a) heating the base;

(b) flame spraying molten copper onto an area of the heated base until globules are observed forming in the area indicative of a build-up of a thermal barrier oxide;

(c) mechanically removing the globules from the heated base; and (d) repeating steps (b) and (c).

2. The method of depositing copper in accordance with claim 1 wherein step (a) the base is heated to a temperature in excess of 1200° F.

3. The method of depositing copper in accordance with claim 1 wherein step (b) the flame spray is moved over the area while those portions of the area momentarily not being impacted with the flame spray are watched for the appearance of the globules.

4. The method of depositing copper in accordance with claim 1 wherein step (c) the globules are ground off the heated base.

* * * * *